US006840179B2

(12) United States Patent
Begotti

(10) Patent No.: US 6,840,179 B2
(45) Date of Patent: Jan. 11, 2005

(54) AMUSEMENT DEVICES, SUCH AS ROLLER-COASTERS

(75) Inventor: Marco Begotti, Suzzara (IT)

(73) Assignee: Ride Tek Engineering S.r.l., Suzzara (IT)

( * ) Notice: Subject to any disclaimer, the term of this patent is extended or adjusted under 35 U.S.C. 154(b) by 57 days.

(21) Appl. No.: 10/303,695

(22) Filed: Nov. 26, 2002

(65) Prior Publication Data

US 2004/0099174 A1 May 27, 2004

(51) Int. Cl.[7] ..... A63G 21/00

(52) U.S. Cl. ..... 105/346; 105/149.1; 105/345; 104/53

(58) Field of Search ..... 104/53, 55, 56, 104/57, 63, 64, 65, 66; 105/149.1, 329.1, 344, 345, 346

(56) References Cited

U.S. PATENT DOCUMENTS

| | | | | | |
|---|---|---|---|---|---|
| 810,646 | A | * | 1/1906 | Harris | 105/344 |
| 4,520,732 | A | * | 6/1985 | Schwarzkopf | 104/53 |
| 5,218,910 | A | * | 6/1993 | Mesmer et al. | 104/63 |
| 5,758,582 | A | * | 6/1998 | Gnezdilov | 104/241 |

* cited by examiner

*Primary Examiner*—Mark T. Le
(74) *Attorney, Agent, or Firm*—Young & Thompson

(57) ABSTRACT

Plant for amusement parks of the kind having a circuit and a series of vehicles joined one to another in an articulated way for the transport of passengers. The vehicles move along a rail track or the like, and can accommodate the transported passengers at different heights.

1 Claim, 3 Drawing Sheets

AMUSEMENT DEVICES, SUCH AS ROLLER-COASTERS

Figure 1:
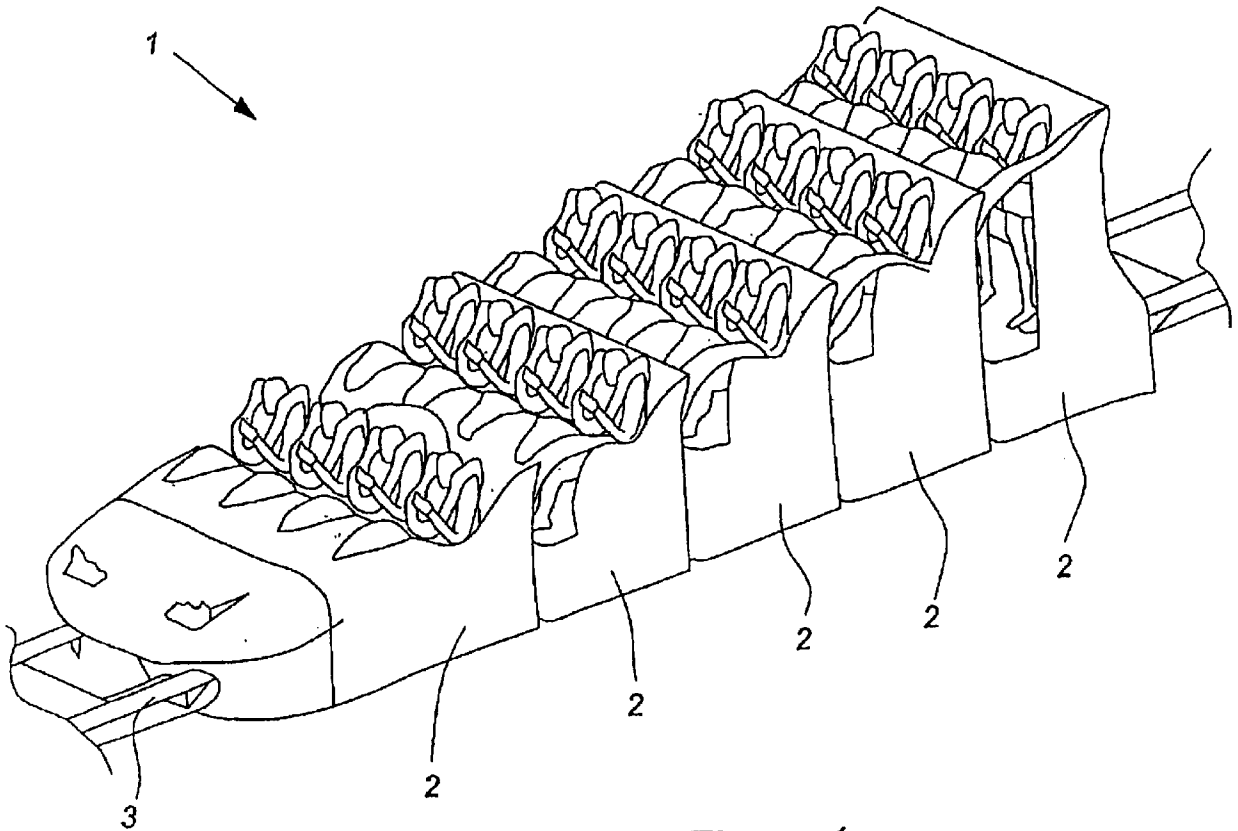

The object of this invention are amusement devices such as roller-coasters including cars or trains running along railways or tracks.

It is known that amusement devices such as roller-coasters are substantially of two types: the one with cars or trains hanging on the carrying structure and the one with the same standing on railways or tracks.

The aim of each of these two solutions is to give extreme sensations to the passenger who is looking for an emotion which is the most similar to the ideal one of free flight.

In case of trains, the sensations experienced by the passengers will change also in function of the position that the same have in the train.

This happens, most of all, in the points of the circuit in which there is a great increase of the sloping, which causes a sudden acceleration of the train. Since all cars move at the same speed, in case of a sudden increase of the sloping, and thus of the speed, because of a bend towards the bottom of the railway, the last cars of the train will arrive at said bend with a greater speed in comparison with the first ones, with the result that the centrifugal force to which to the passengers of the last cars are subjected, will be greater than the one which acts on the passengers of the first cars.

The advantage of the technology of hanging trains is to leave the passenger's legs free in the air, thus reducing the safety sensation and obtaining, thanks to this fact, a great increase of the emotion deriving from vertical and horizontal accelerations.

Unfortunately, in order to obtain this effect of amplification of the emotion, the compartment or accommodation, in which the passenger is hosted, has to have its upper part hanging on the carrying structure, such as a railway, and because of this feature it may happen that the view of the passenger is limited to the front compartment or to the same railway, creating a visual effect called tunnel.

Substantially, the view of the passenger is limited and can not wander all around to see the rest of the run that the compartment or the accommodation have to cover.

Said inconvenience does not happen in the kind of carriages hanging on the carrying structure, which allow the passenger to have a free view during the most part of the run. Nevertheless, the greatest emotion consequent to this fact is partially thwarted by the fact that the passengers of the rear cars have not the same view of the run than the ones of the first cars or, more precisely, of the first row of the first car.

In fact, the view is limited forward by the presence of the passengers and by all supporting and protection structures of the same.

The present invention solves this inconvenience thanks to the use of a vehicle including a plurality of cars, joined one to another in an unknotted way and forming a train, each of them hosting one or more persons, being said persons placed on different heights; namely the ones behind are higher than the ones in front, so that each of them can see all the run without the limitations due to the persons preceding in the row.

Figure 2:
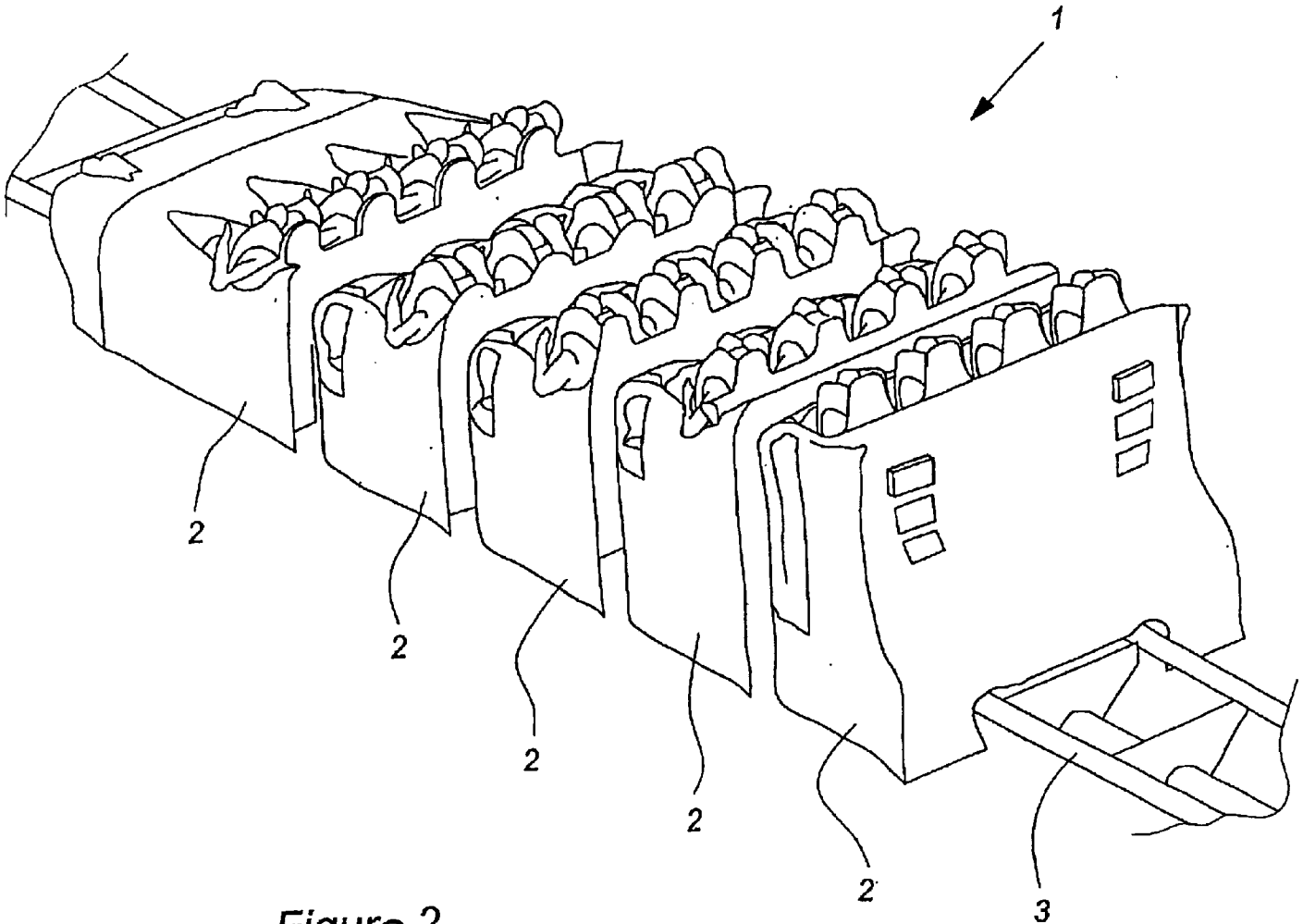
Figure 3:
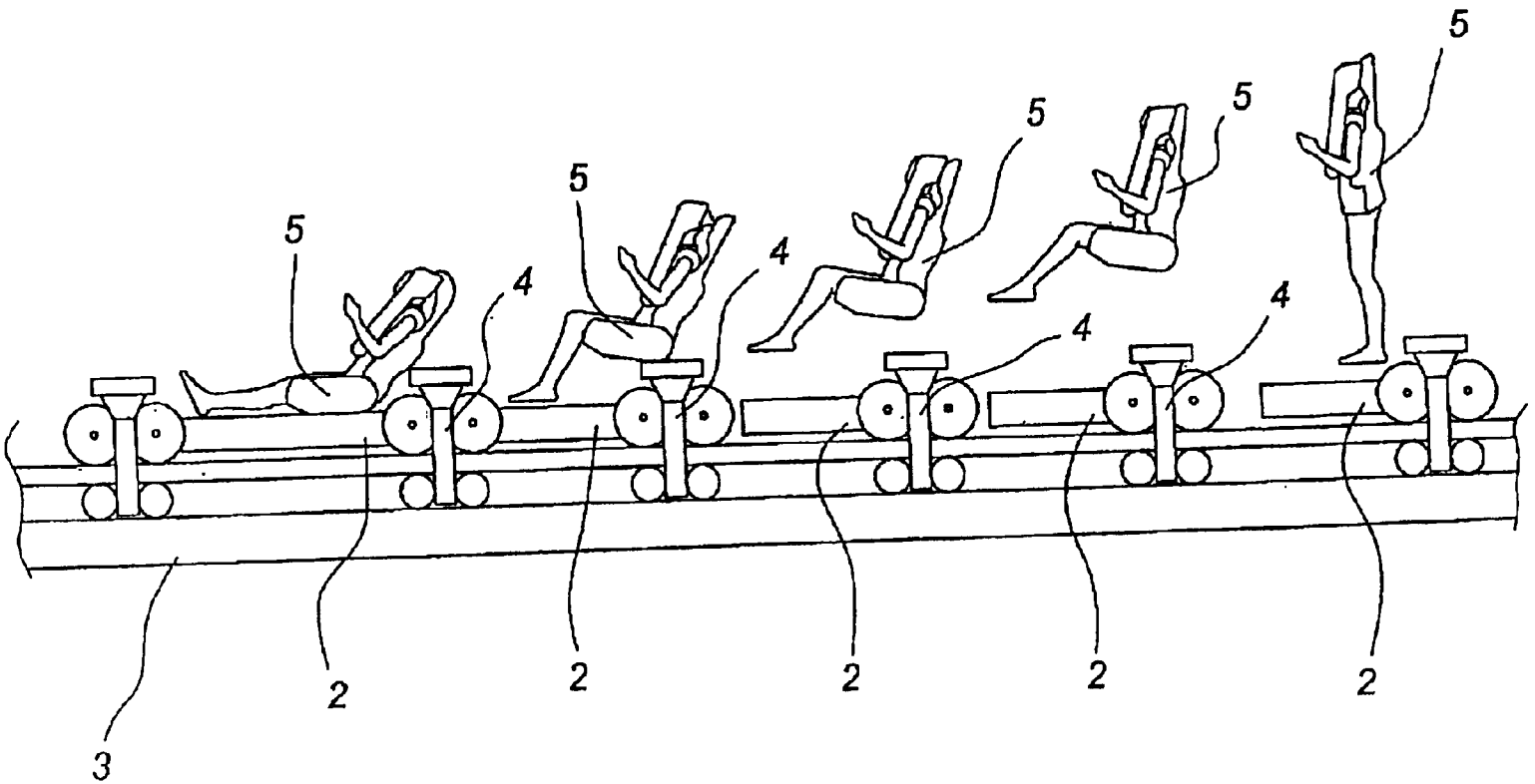

This innovation will now be described with reference to the attached figures in which:

FIG. 1 is a front perspective view of the vehicle according to the invention, FIG. 2 is a rear perspective view of the vehicle showing its composition, FIG. 3 shows the disposition of the passengers in any row of the vehicle.

With reference to FIGS. 1 and 2 the vehicle (1) according to the invention is shown, constituted by a plurality of trolleys (2), running on a railway (3). These trolleys (2) are joined one to another by well-known universal joints (4) acting as a ball joint, so as to allow adjacent trolleys to assume, within a certain extent, any mutual orientation.

According to a possible preferred embodiment, the first trolley will be equipped with front and rear wheels, while the other trolleys of the train will be equipped only with rear wheels, hanging on the preceding trolley, by means of said joint (4).

Said trolleys can however be equipped with front and rear wheels, leaving to the joint (4) the only function of connection.

As shown in FIG. 3, on each trolley one or more seats (5) are placed side by side. In case the passenger in the last trolley is standing, on said last trolley well-known supporting means are provided to hold said passenger upright, giving the support necessary to bear strong accelerations.

Said seats (5) are characterized in that they accommodate the passengers in a higher and more and more upright position starting from the seats of the first trolley, in which the passenger is in a very sloping backward position with the lower limbs being stretched. The position of said seats (5) is such that the passengers of each row will be staggered in height of about 20 cm upwards than the passengers of the preceding row.

A clear advantage of the solution according to the invention is the fact that the disposition of the people is such that it is possible to have a whole visual of the run in any carriage of the train, wherever seated.

Another advantage is the fact that with just one vide and one vehicle, the passengers will be free to chose the preferable position in a wide range of possibilities.

What is claimed is:

1. Device for amusement parks, comprising a circuit which is a series of vehicles for the transport of passengers, said vehicles being joined one to another in an articulated way and moving along a rail track, wherein each vehicle has seats arranged in rows that can accommodate passengers of different heights, said seats being more and more upright from one row to the next row starting from the first row toward the last row.

* * * * *